US008267678B2

(12) United States Patent
Ohtahara et al.

(10) Patent No.: US 8,267,678 B2
(45) Date of Patent: Sep. 18, 2012

(54) VANE TYPE VACUUM PUMP

(75) Inventors: Kiyotaka Ohtahara, Toyota (JP); Kikuji Hayashida, Toyota (JP); Naoto Noguchi, Toyota (JP)

(73) Assignee: Taiho Kogyo Co., Ltd., Toyota-shi, Aichi (JP)

( * ) Notice: Subject to any disclaimer, the term of this patent is extended or adjusted under 35 U.S.C. 154(b) by 488 days.

(21) Appl. No.: 12/450,053

(22) PCT Filed: Jun. 11, 2008

(86) PCT No.: PCT/JP2008/060679

§ 371 (c)(1),
(2), (4) Date: Sep. 8, 2009

(87) PCT Pub. No.: WO2009/001677

PCT Pub. Date: Dec. 31, 2008

(65) Prior Publication Data

US 2010/0092323 A1 Apr. 15, 2010

(30) Foreign Application Priority Data

Jun. 26, 2007 (JP) ..... 2007-167817

(51) Int. Cl.
*F01C 1/10* (2006.01)
*F03C 2/00* (2006.01)
*F03C 4/00* (2006.01)

(52) U.S. Cl. ..... 418/255; 418/30; 418/76; 418/81; 418/132

(58) Field of Classification Search ..... 418/30, 418/75–81, 132, 253–255
See application file for complete search history.

(56) References Cited

U.S. PATENT DOCUMENTS

| | | | | |
|---|---|---|---|---|
| 3,877,851 | A * | 4/1975 | Komiya et al. | 418/76 |
| 4,516,918 | A | 5/1985 | Drutchas et al. | |
| 7,014,439 | B2 * | 3/2006 | Kano et al. | 418/81 |

FOREIGN PATENT DOCUMENTS

| | | | | |
|---|---|---|---|---|
| JP | 51-116407 | | 10/1976 | |
| JP | 54-161102 | | 12/1979 | |
| JP | 59-28081 | | 2/1984 | |
| JP | 03111682 | A * | 5/1991 | 418/78 |
| JP | 2000-205159 | | 7/2000 | |
| JP | 2004-076735 | | 3/2004 | |
| JP | 2005256684 | A * | 9/2005 | |
| JP | 2006226164 | A * | 8/2006 | 418/255 |
| JP | 2006226165 | A * | 8/2006 | 418/255 |
| JP | 2006226166 | A * | 8/2006 | 418/255 |

OTHER PUBLICATIONS

International Search Report dated Jul. 15, 2008 (3 pages).
Form PCT/ISA/220 (4 pages).
Form PCT/ISA/237 (4 pages).

* cited by examiner

*Primary Examiner* — Theresa Trieu
(74) *Attorney, Agent, or Firm* — Flynn, Thiel, Boutell & Tanis, P.C.

(57) ABSTRACT

A vane type vacuum pump 1 is provided in the vicinity of an air intake passage 11 for sucking the air into a pump chamber 2, and communicates a space A on the front side and a space B on the back side of the rotational direction of the vane at the time of the reverse rotation of the vane 6, and includes an escaping groove 21 for allowing a lubricating oil to escape into the space B on the back side from the space A on the front side.

4 Claims, 3 Drawing Sheets

VANE TYPE VACUUM PUMP

TECHNICAL FIELD

The present invention relates to a vane type vacuum pump, and more in particular, it relates to a vane type vacuum pump provided with an escaping groove for allowing a lubricating oil to escape into a space on the back side from a space on the front side of a vane at the time of the reverse rotation of the vane.

BACKGROUND ART

Heretofore, a vane type vacuum pump provided with an escaping groove for allowing a lubricating oil to escape at the time of the reverse rotation of the vane is publicly known (Patent document No. 1).

That is, the vane type vacuum pump includes a housing provided with a nearly circular pump chamber, side plates sealing opposing end surfaces of this housing, a rotor rotating at a position eccentric to a center of the pump chamber, a vane reciprocating along a groove formed in the diameter direction of the rotor and rotating while partitioning the pump chamber into a plurality of spaces, and an escaping groove provided in the vicinity of an air intake passage through which the air is sucked into the pump chamber and communicating a space on the front side and a space on the back side of the rotational direction of the vane at the time of the reverse rotation of the vane, thereby allowing the lubricating oil to escape into the space on the back side from the space on the front side.

At the reverse rotation time in which the rotor rotates in the direction opposite to a normal direction, a compression effect is generated in the vicinity of the air intake passage. The vane type vacuum pump is generally driven by the engine of an automobile, and therefore, when the engine is reversely rotated, the rotor and the vane of the vane type vacuum pump are also reversely rotated. More specifically, the compression action occurs in the case where manual transmission car is stopped in an upward slope, and in a state in which the engine shuts down, the wheels and the engine are connected through a clutch, and in this state, the wheels pull back in the slope.

Now, at the engine shutdown time, though a stored amount of the lubricating oil is different depending on a mounted state of the vane type vacuum pump to the vehicle and a condition such as configuration and the like of the feeding passage of the lubricating oil to the pump chamber, it is known that since the inside of the pump chamber is maintained in a negative pressure state, the required volume of the lubricating oil is sucked and stored inside the pump chamber. When the vane is reversely rotated in this state, supposing that the escaping groove is not provided, because the lubricating oil is a non-compressible liquid, the pressure in the vicinity of the air intake passage becomes extremely high, and there arise problems that the vane is broken or a check valve is broken when the check valve allowing a flow of the air to the pump chamber is provided in the middle of the air intake passage.

Since the escaping groove can communicate the space on the front side and the space on the back side of the rotational direction of the vane at the time of the reverse rotation of the vane in the vicinity of the air intake passage, the lubricating oil can be allowed to escape from the space on the front side to the space on the back side by this escaping groove, and this can prevent the breakage of the vane and the check valve.

[Patent document No. 1] Japanese Laid-Open Patent Application No. 2000-205159

DISCLOSURE OF INVENTION

Problems to be Solved by the Invention

Although the escaping groove may be provided on the inner peripheral surface of the housing or on the inner surface of side plates, when the housing and one of the side plates are integrally cast by a die cast, the escaping groove is desirably provided on the side plate in the light of easiness of the manufacture. However, when the escaping groove of a square section is formed on the side plate, it was found that the vane type vacuum pump is at a risk of being damaged by foreign matters and friction powders.

That is, as described above, since the escaping groove is provided in the vicinity of the air intake passage, when the vane is normally rotated, no large pressure difference is generated between the space on the front side and the space on the back side of the normal rotational direction of the vane, and consequently, this hardly causes the movement of the air and the lubricating oil inside the escaping groove. On the other hand, the lubricating oil supplied to the vacuum pump is sometimes mixed with the foreign matters and friction powders, and such foreign matters and friction powders are trapped inside the escaping groove when the vane moves across the escaping groove, particularly by a wall surface of the escaping groove which becomes a front side of the normal rotational direction of the vane, and are stored in a corner portion between the wall surface and the bottom on the front side. As described above, when the vane is normally rotated, this hardly causes the movement of the air and the lubricating oil inside the escaping groove, and gradually increases the foreign matters and friction powders stored in the corner portion between the wall surface and the bottom on the front side of the escaping groove.

At the time of the reverse rotation of the vane, though the lubricating oil can be allowed to escape from the space on the front side to the space on the back side of the reverse rotational direction of the vane by the escaping groove, when a cross sectional shape of the escaping groove is a square section, the foreign matters and friction powders stored in the corner portion between the wall surface and the bottom cannot be excellently removed, and in spite of the reverse rotation of the vane, the foreign matters and friction powders were liable to be kept trapped inside the escaping groove.

As a result, quantities of the foreign matters and friction powders trapped inside the escaping groove become relatively large, and during the normal rotation of the vane, particularly during a high speed rotation, when the large quantities of the foreign matters and friction powders are discharged into the pump chamber from the inside of the escaping groove for some reasons, they are caught by a sliding surface between the vane and the housing and a sliding surface between the vane and the side plate, thereby having a risk of damaging the sliding surfaces.

Means to Solve the Problems

In view of the above described circumstances, the present invention aims at providing a vane type vacuum pump capable of excellently removing the foreign matters and friction powders from the escaping groove at the time of the reverse rotation of the vane and preventing as much as possible the large quantities of the foreign matters and friction powders from being stored in the escaping groove.

That is, the present invention is a vane type vacuum pump, including a housing provided with a nearly circular pump chamber, side plates sealing opposing end surfaces of this housing, a rotor rotating at a position eccentric to the center of the pump chamber, a vane reciprocating along a groove formed in the diameter direction of the rotor and rotating while partitioning the pump chamber into a plurality of spaces, and an escaping groove provided in the vicinity of an air intake passage through which the air is sucked into the pump chamber and communicating the space on the front side and a space on the back side of the rotational direction of the vane at the time of the reverse rotation of the vane, thereby allowing the lubricating oil to escape into the space on the back side from the space on the front side, wherein the escaping groove is provided in the side plate, and moreover, a wall surface of the escaping groove which is on the back side of the rotational direction of the vane at the time of the reverse rotation of the vane is made into an inclined surface whose opening side is further expanded than the bottom of the escaping groove.

Effect of the Invention

According to the above described configuration, at the time of the reverse rotation of the vane, by the escaping groove, the lubricating oil can be allowed to escape from the space on the front side to the space on the back side of the reverse rotational direction of the vane. However, at this time, a wall surface of the escaping groove which becomes the back side of the rotational direction of the vane at the time of the reverse rotation of the vane is made into an inclined surface whose opening side is further expanded than the bottom of the escaping groove, and therefore, the foreign matters and friction powders stored across the wall surface and the bottom are easily pushed out along the inclined surface by the flow of the lubricating oil.

Consequently, comparing with the case where the sectional shape of the escaping groove is made a square section, the foreign matters and friction powders are allowed to smoothly escape, and can be removed from the inside of the escaping groove, thereby preventing as much as possible the relatively large quantities of the foreign matters and friction powders from being discharged into the pump chamber during the normal rotation of the vane and reducing a risk of the large quantities of the foreign matters and friction powders damaging the sliding surface between the vane and the housing and the sliding surface between the vane and the side plate.

DESCRIPTION OF SYMBOLS

Figure 1:
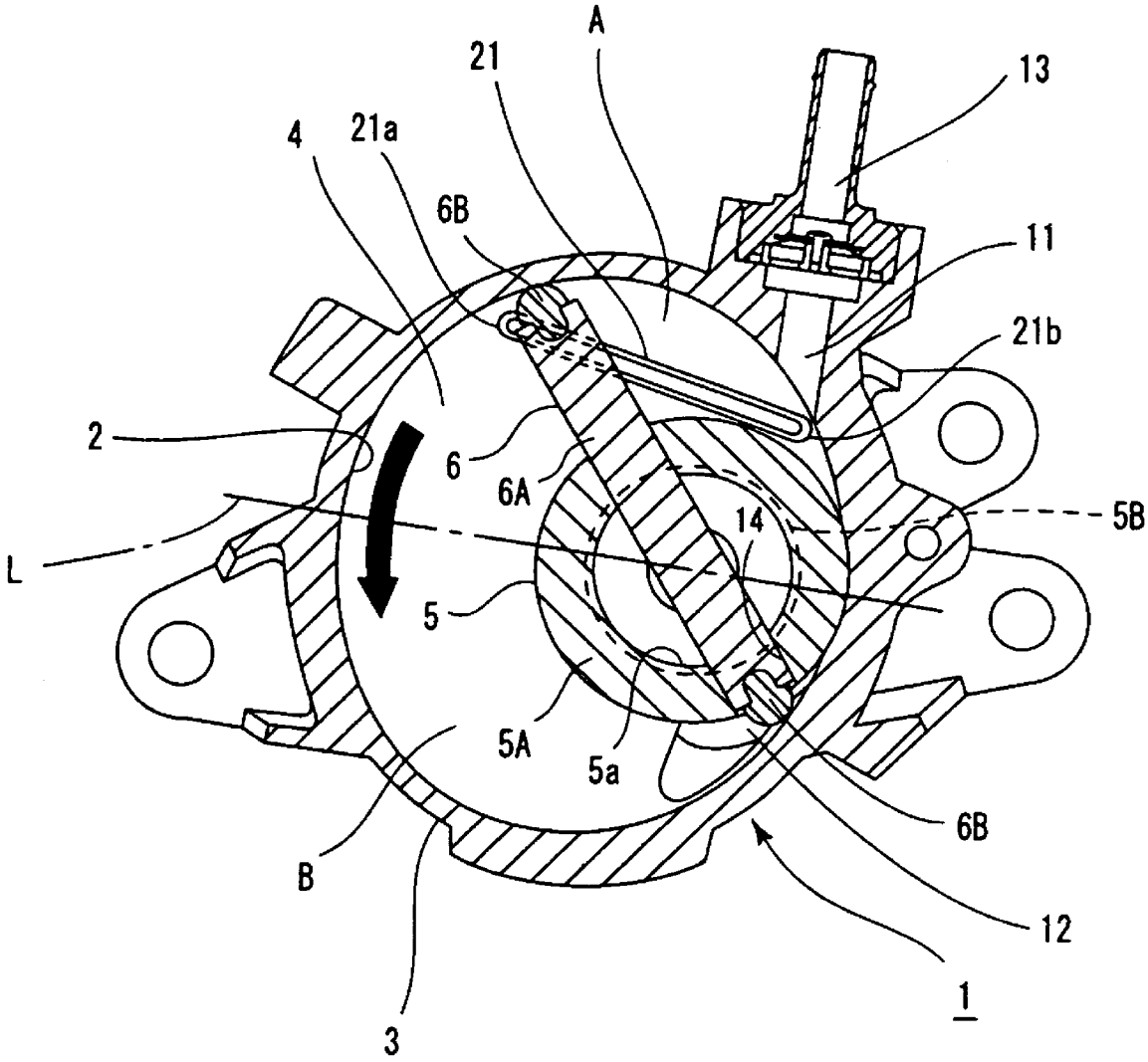
FIG. 1 is a front view of a vane pump 1 in a first embodiment.

1 Vacuum pump
2 Pump chamber
3 Housing
4 Side plate
5 Rotor
6 Vane
11 Air intake passage
12 Discharge passage
13 Check valve
14 Groove
21 Escaping groove
21A, 21C Wall surface
21B Bottom
22 Foreign matters and friction powders
A Space on the front side of the reverse rotational direction
B Space on the back side of the reverse rotational direction

BEST MODE FOR CARRYING OUT THE INVENTION

Hereinafter, describing the present invention with reference to the illustrated embodiment, in FIG. 1, a vane type vacuum pump 1 is fixed to the side surface of an engine of an unillustrated automobile so as to generate a negative pressure for a booster of an unillustrated brake system.

This vane type vacuum pump 1 includes a housing 3 forming a nearly circular pump chamber 2, side plates 4 (one side plate only is illustrated) sealing opposing end surfaces of this housing 3, a rotor 5 rotating by a drive force of the engine at a position eccentric to a center of the pump chamber 2, and a vane 6 rotated by the rotor 5 and partitioning the pump chamber 2 always into a plurality of spaces. The rotor 5 and the vane 6, in a normal state, are rotated and driven in a counterclock direction shown by an arrow mark.

The housing 3 is formed with an air intake passage 11 communicating with the booster of the brake and sucking the air inside the booster above the pump chamber 2, and the side plates 4 are provided with a discharge passage 12 for discharging the air sucked from the booster and the lubricating oil fed from an unillustrated feeding passage below the pump chamber 2. The air intake passage 11 is provided with a check valve 13 for maintaining the negative pressure of the booster particularly at the engine shutdown time.

The pump chamber 2 is fed with the lubricating oil through an unillustrated feeding passage, and a communicating opening of the feeding passage is formed at the front side of the rotational direction of the vane 6 rather than at the forming position of the discharge passage 12. Hence, the vane 6, after passing through the discharge passage 12, passes through the feeding passage, and the lubricating oil fed from the feeding passage is not discharged as, it is from the discharge passage 12.

The rotor 5 includes a cylindrical rotor portion 5A rotating inside the pump chamber 2 and a bearing portion 5B rotatably journaled by the side plates 4. The outer periphery of the rotor portion 5A contacts an inner peripheral surface of the housing 3, and further, by sandwiching a center line L connecting the center of the rotor portion 5A and the center of the pump chamber 2, the air intake passage 11 and the discharge passage 12 are provided.

The center of the rotor portion 5A is formed with a hollow portion 5*a*, and at the same time, is formed with a groove 14 in the diameter direction, and along the inside of the groove 14, the vane 6 can be slidably moved in the direction orthogonal to the axial direction of the rotor 5.

The vane 6 includes a planar main body 6A slidably held by the groove 14 and cap portions 6B in a semicylindrical shape provided to freely project and retract respectively at opposing end portions of this main body 6A. Opposing side surfaces of the vane 6 are brought into sliding contact with the side plates 4 respectively, thereby sealing the contact portions, and at the same time, the top end portion of each cap portion 6B is brought into sliding contact with the inner peripheral surface of the housing 3, thereby sealing the contact portion. As a result, the vane 6 can rotate, while partitioning the pump chamber 2 into a plurality of spaces (two spaces in the illustrated embodiment).

Further, the inner surface of one of the side plates 4, that is, the surface with which the vane 6 is in sliding contact is formed with an escaping groove 21 communicating a space A on the front side and a space B on the back side of the rotational direction of the vane 6 at the reverse rotation time of the vane 6 (at the rotation time in the clockwise direction of FIG. 1) in the vicinity of the air intake passage 11 and allowing the lubricating oil to escape from the space A on the front side to the space B on the back side.

This escaping groove 21, when the vane 6 superposes with the escaping groove 21, can communicate the space A and the space B through the escaping groove 21.

The top end portion 21*a* of the escaping groove 21, that is, the top end portion 21*a* superposing with the escaping groove 21, first when the vane 6 reversely rotates is formed at a position capable of starting communication with the space A on the front side and the space B on the back side of the rotational direction when a volume of the space A on the front side of the rotational direction of the vane 6 at the time of the reverse rotation of the vane 6 reaches a predetermined amount. This is because the space A on the front side of the rotational direction at the time of the reverse rotation of the vane 6 operates in a direction to compress the lubricating oil, and therefore, unless the lubricating oil is allowed to escape from the space A into the space B on the back side through the escaping groove 21 in a moment when the space A is compressed to a predetermined amount supposing that the lubricating oil of the predetermined amount is present inside the space A, the lubricating oil which is incompressible inside the space A is compressed and the pressure inside the space A becomes extremely high, so that there is a risk of damaging the vane 6 and the check valve 13.

The predetermined amount can be set by experimentally obtaining the maximum value of the lubricating oil flowing into the pump chamber 2 from the feeding passage at the engine shutdown time, and consequently at the shutdown time of the vacuum pump 1.

On the other hand, the back end portion 21*b* of the escaping groove 21, that is, the back end portion 21*b* released from superposing with the vane 6 finally when the vane 6 reversely rotates is formed so as to block a communication with the space A on the front side and the space B on the back side of the rotational direction between a position at which the vane 6 passes through the air intake passage 11 at the time of the reverse rotation of the vane 6 and a position at which the compression in the space A on the front side of the rotational direction is substantially completed.

At this time, though the compression of the lubricating oil inside the space A continues between the position from which the vane 6 passes through the air intake passage 11 and the position at which the compression is substantially completed, because of the facts that a flow of the lubricating oil to the air intake passage 11 is shut down due to the reverse rotation, a majority of the lubricating oil is allowed to escape to the space B on the back side from escaping groove 21 and its pressure amount is few, the top end portion of the vane 6 is practically buried inside the rotor 5 with its rigidity increased, and the lubricating oil can escape from the space A through clearance of each part, even when the back end portion 21*b* of the escaping groove 21 is formed between a position at which the vane 6 passes through the air intake passage 11 and a position at which the compression in the space A is substantially completed, there occurs no problem.

The top end portion 21*a* and the back end portion 21*b* of the escaping groove 21 are formed at a position close to the inner peripheral surface of the housing 3, and at the same time, opposing end portions 21*a* and 21*b* are formed on a straight line, so that, similarly to the case where the escaping groove 21 is formed in a circular arc shape with the rotational center of the rotor 5 as a center, the side surface of the vane 6 passing through on the escaping groove 21 is prevented as much as possible from passing through on the escaping groove 21 at the same position, so that an abnormal wear caused by bringing the escaping groove 21 into sliding contact with the vane 6 at the same position can be prevented.

Figure 2:
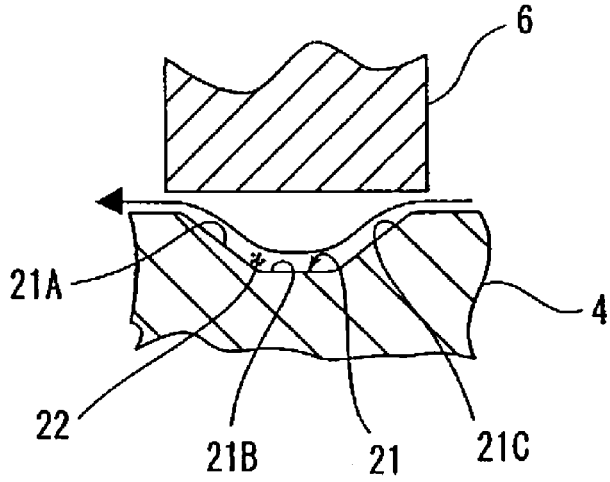
FIG. 2 is an enlarged sectional view showing an escaping groove 21 of FIG. 1, which is sectioned.

FIG. 2 is a sectional view cutting off the escaping groove 21 in the direction orthogonal to its longitudinal direction, in which the sectional shape of the escaping groove 21 is formed in a trapezoidal shape whose opening side is expanded.

That is, at the time of the reverse rotation of the vane 6, the vane rotates and moves so as to come across the escaping groove 21 from the left to the right of FIG. 2, and consequently, the lubricating oil is allowed to escape from the space A on the front side to the space B on the back side of the rotational direction through the escaping groove 21. In the present embodiment, a wall surface 21A of the escaping groove 21 which becomes the back side of the rotational direction of the vane 6 at the time of the reverse rotation of the vane 6 is formed on the inclined surface whose opening side is further expanded than the bottom 21B of the escaping groove 21 so that the foreign matters and friction powders 22 trapped inside the escaping groove 21 are smoothly discharged from the inside of the escaping groove 21 by the flow of the lubricating oil.

On the other hand, a wall surface 21C of the escaping groove which becomes the front side of the rotational direction of the vane 6 at the time of the reverse rotation of the vane 6 is also formed on the inclined surface whose opening side is further expanded than the bottom 21B of the escaping groove 21, and by forming the sectional shape of the escaping groove 21 in a trapezoidal shape, the lubricating oil smoothly flows to the bottom 21B and the other wall surface 21A from one wall surface 21C of the escaping groove 21 along these surfaces, thereby the foreign matters and friction powders 22 trapped inside the escaping groove 21 are allowed to escape more reliably and can be discharged from the escaping groove 21 into the pump chamber 2. Further, even in the light of making the manufacture easy by the die cast, the opening side rather than the bottom 21B of the escaping groove 21 is desirably formed as the enlarged inclined surface.

That is, in general, though one of the side plates 4 is manufactured integrally with the housing 3 by the die cast, the housing 3 is formed with the air intake passage 11, and the side plate 4 is formed with the discharge passage 12, and therefore, a trimming die of the die cast device becomes a complicated structure. At this time, when the escaping groove 21 formed on the side plate 4 is formed in the trapezoidal shape as described above, product extraction from the die cast device becomes easy, and consequently, the manufacture becomes easy.

In the above described configuration, when the rotor 5 is positively rotated in the normal direction by the operation of the engine, the vane 6 comes to be rotated while reciprocating inside the groove 14 of the rotor 5. When one of the cap portions 6B of the vane 6 passes through the air intake passage 11, the volume of the space on the back side of the rotational direction is increased by the cap portion 6B, thereby the air inside the booster is sucked into the pump chamber 2 through the check valve 13 and the air intake passage 11.

When the other of the cap portions 6B passes through the air intake passage 11, the space is shut off from communication with the air intake passage 11, and the air inside the space is discharged to the outside through the discharge passage 12, while being compressed by the continuous rotation of the vane 6.

When the vane 6 passes in the vicinity of the air intake passage 11, though the vane 6 is superposed with the escaping groove 21, in this state, the spaces before and after the vane 6 are not generated with a large pressure difference, and consequently, the air and the lubricating oil will not flow into the escaping groove 21 with great force.

A portion of the foreign matters and friction powders 22 contained in the lubricating oil flowed into the pump chamber 2 from the above described feeding passage is adhered to the vane 6 and is integrally transferred, and when the vane 6 moves across over the escaping groove 21, that portion is scraped off from the vane 6 by the escaping groove 21, particularly, by an opening side corner portion of the wall surface 21A of the escaping groove 21 which becomes the front side (the left side in FIG. 2) of the normal rotational direction of the vane 6, and is trapped inside the escaping groove 21.

After that, the foreign matters and friction powders 22 trapped inside the escaping groove 21 are quickly discharged from the inside of the escaping groove 21, and are sometimes transferred out of the pump chamber 2. However, as described above, when the vane 6 is positively rotating, since the movement of the air and the lubricating oil inside the escaping groove 21 is negligible, the foreign matters and friction powders 22 trapped inside the escaping groove 21 are liable to stay inside the escaping groove 21 with a result that the foreign matters and friction powders 22 are gradually increased, and are mainly stored and adhered to the corner portion between the wall surface 21A and the bottom 21B of the front side of the escaping groove 21.

On the other hand, when the vane 6 is reversely rotated, in the vicinity of the air intake passage 11, the space on the front side of the reverse rotation direction of the vane 6 is compressed. However, before the lubricating oil stayed in the space on the front side is compressed, the spaces before and after the vane 6 are communicated through the escaping groove 21, and therefore, as shown in FIG. 2, the lubricating oil inside the space A on the front side is discharged into the space B on the back side through the escaping groove 21.

At this time, in the present embodiment, since the sectional shape of the escaping groove 21 is formed in the trapezoidal shape, the lubricating oil smoothly flows from one wall surface 21C to the bottom 21B and the other wall surface 21A of the escaping groove 21 along these surfaces, thereby the foreign matters and friction powders 22 trapped inside the escaping groove 21 are allowed to escape more reliably and can be discharged from the escaping groove 21 into the pump chamber 2. The foreign matters and friction powders 22 discharged into the pump chamber 2 are discharged to the outside from the inside of the pump chamber 2 at the next normal rotation of the vane 6.

Figure 3:
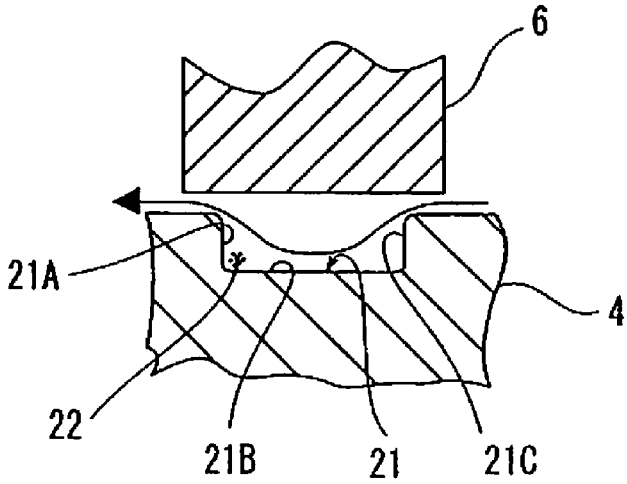
PRIOR ART FIG.3
FIG. 3 is a sectional view showing a conventional escaping groove.

In contrast to this, similarly to the conventional example shown in FIG. 3, when the sectional shape of the escaping groove 21 is made square-shaped, the lubricating oil hardly flows into the corner portion of the wall surfaces 21A and 21C and the bottom 21B of the escaping groove 21, and the foreign matters and friction powders 22 are liable to remain adhered to that portion, and it is highly possible that there is a risk of creating problems.

Figure 4:
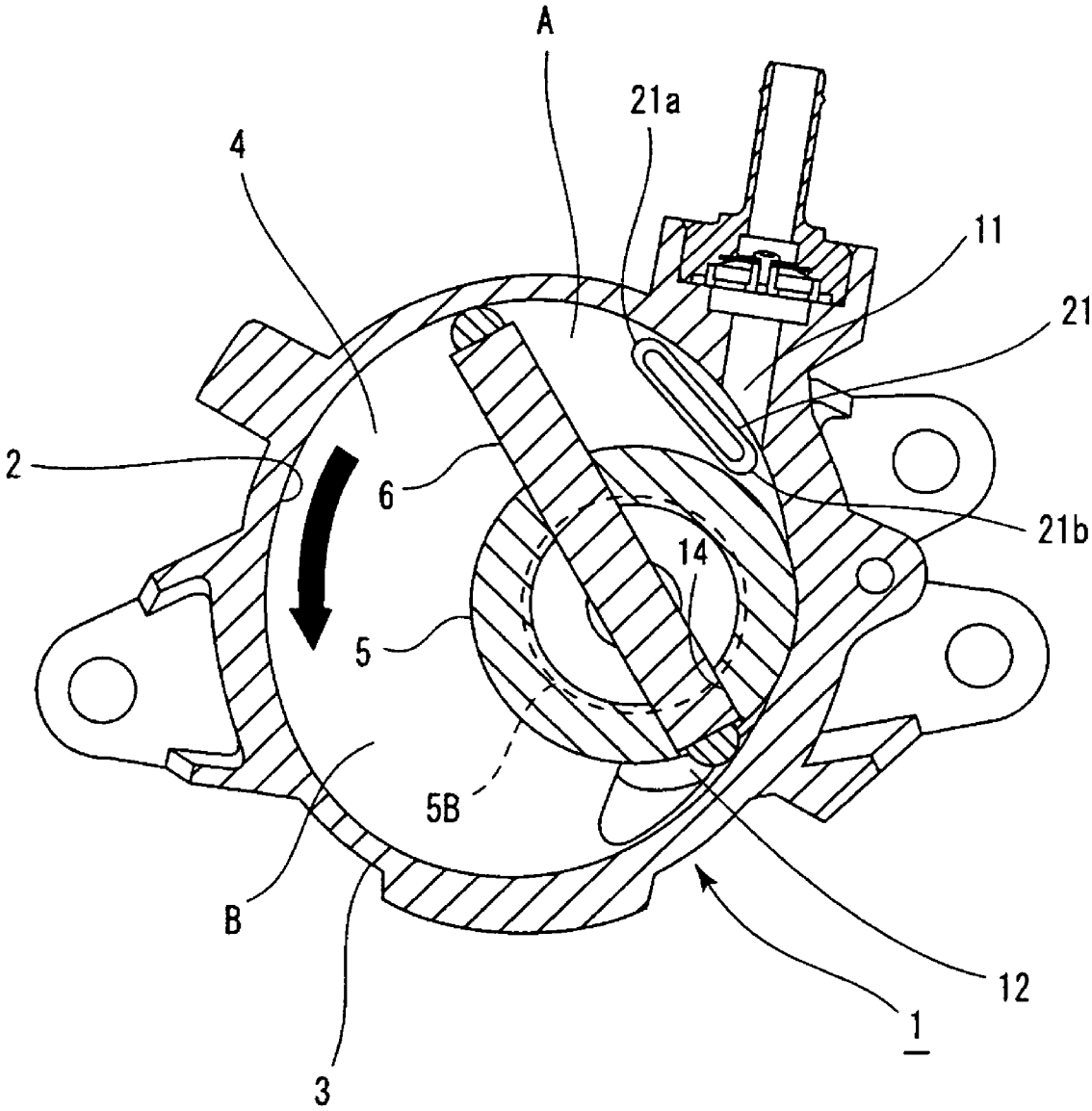
FIG. 4 is a front view of the vane pump 1 in a second embodiment.

FIG. 4 shows an embodiment on the vacuum pump 1 in which the maximum value of the lubricating oil stayed inside the pump chamber 2 at the operation shutdown time is smaller than the case of the first embodiment.

In the present embodiment, the position of the top end portion 21*a* of the escaping groove 21 is brought closer to the air intake passage 11 side than the case of the first embodiment, thereby, when the volume of the space A on the front side of the reverse rotational direction of the vane 6 becomes smaller than the case of the first embodiment, the top end portion is formed at the position capable of starting communication with the space A on the front side and the space B on the back side of the reverse rotational direction.

On the other hand, the back end portion 21*b* of the escaping groove 21, similarly to the case of the first embodiment, is formed at a position in which the communication between the space A on the front side and the space B on the back side of the rotational direction is shut down between a position at which the vane 6 passes through the air intake passage 11 at the time of the reverse rotation and a position in which the compression in the space A on the front side of the rotational direction is completed.

In the present embodiment also, it is apparent that the same operation effect as the first embodiment can be obtained.

In each of the above described embodiments, though a description has been made by using the vane pump 1 provided with one piece of the vane 6, even the vane pump provided with a plurality of vanes as known heretofore can be also applied to the present invention.

The invention claimed is:

1. A vane type vacuum pump, comprising a housing provided with a nearly circular pump chamber, side plates sealing opposing end surfaces of this housing, a rotor rotating at a position eccentric to the center of said pump chamber, a vane reciprocating along a groove formed in the diameter direction of the rotor and rotating while partitioning the pump chamber into a plurality of spaces, and an escaping groove provided in the vicinity of an air intake passage through which the air is sucked into said pump chamber and communicating a space on the front side and a space on the back side of the rotational direction of the vane at the time of the reverse rotation of the vane, thereby allowing the lubricating oil to escape into the space on the back side from the space on the front side, wherein said escaping groove is provided in the side plate, and moreover, a wall surface of said escaping groove which is on the back side of the rotational direction of the vane at the time of the reverse rotation of said vane is made into an inclined surface whose opening side is further expanded than a bottom of the escaping groove.

2. The vane type vacuum pump according to claim 1, wherein a wall surface of said escaping groove which is on the front side of the rotational direction of the vane at the time of the reverse rotation of said vane is made into an inclined surface whose opening side is further expanded than the bottom of the escaping groove.

3. The vane type vacuum pump according to claim 1, wherein a top end portion of said escaping groove superposing with the vane first when said vane reversely rotates is formed at a position which starts communication with the space on the front side and the space on the back side of the rotational direction when a volume of the space on the front side of the reverse rotational direction of the vane becomes the maximum value of a lubricating oil flowing into a pump chamber at the shutdown time of the vacuum pump.

4. The vane type vacuum pump according to claim 1, wherein the back end portion of said escaping groove released from superposing with the vane finally when said vane reversely rotates is formed so as to block a communication with the space on the front side and the space on the back side of the reverse rotational direction between a position at which the vane passes through the air intake passage at the time of the reverse rotation of the vane and a position at which the compression in the space on the front side of the rotational direction is completed.

* * * * *